United States Patent [19]

Prada

[11] Patent Number: 4,474,017

[45] Date of Patent: Oct. 2, 1984

[54] METHOD OF ASSEMBLING AN ANTI-SWEAT HEATER IN A REFRIGERATOR CABINET

[75] Inventor: Luis E. Prada, Louisville, Ky.

[73] Assignee: General Electric Company, Louisville, Ky.

[21] Appl. No.: 415,065

[22] Filed: Sep. 7, 1982

[51] Int. Cl.[3] ..... F25B 45/00

[52] U.S. Cl. ..... 62/77; 62/277; 29/437

[58] Field of Search ..... 62/277, 298, 81, 77; 312/214, 296; 29/437, 453, 157.3 C

[56] References Cited

U.S. PATENT DOCUMENTS 3,835,660 9/1974 Franck ..... 62/277

4,158,294 6/1979 Keeling, Jr. ..... 62/277

*Primary Examiner*—Albert J. Makay

*Assistant Examiner*—Henry Bennett

*Attorney, Agent, or Firm*—Frederick P. Weidner; Radford M. Reams

[57] ABSTRACT

There is provided a method of assembling an anti-sweat heater in a refrigerator cabinet that includes forming the outer case of the cabinet with a sidewall and front face having a right angle corner therebetween and a flange spaced from the corner and inwardly turned from the front face with a depending lip extending towards and spaced from the cabinet sidewall. A heater retainer member is formed and has a portion thereof in cross section view with a front end shaped to receive the heater, a straight center section and two flexible wings, one on each side of the center section and diverging from the center section away from the front end, and also a rear end. The anti-sweat heater is placed in the front end of the retainer member and the heater and front end and center section including the wings of the retainer member are inserted through the space between the depending lip of the flange and the cabinet sidewall. The heater is held in the corner with the front end of the retainer member and a wing of the retainer member is positioned under and in contact with the depending lip of the flange, thereby exerting force against the heater to retain it in the corner. In this manner, the anti-sweat heater is retained in the corner which is its proper position for effective prevention of condensate on the cabinet and is maintained in the corner during subsequent placement of insulating material in the cabinet.

6 Claims, 6 Drawing Figures

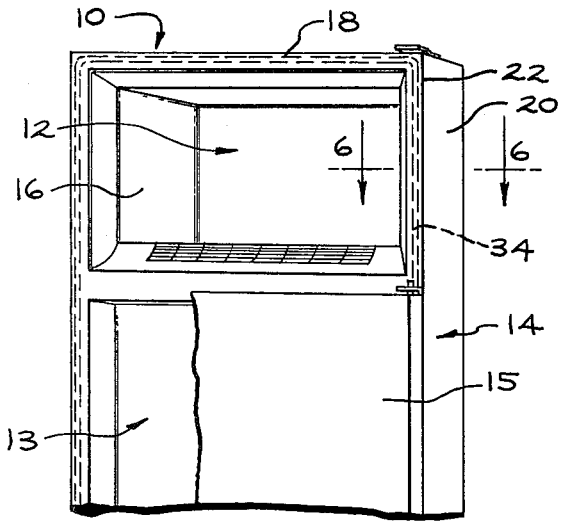
FIG. 1
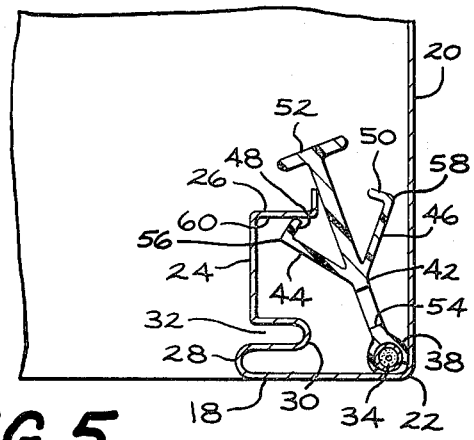
FIG. 5
FIG. 6
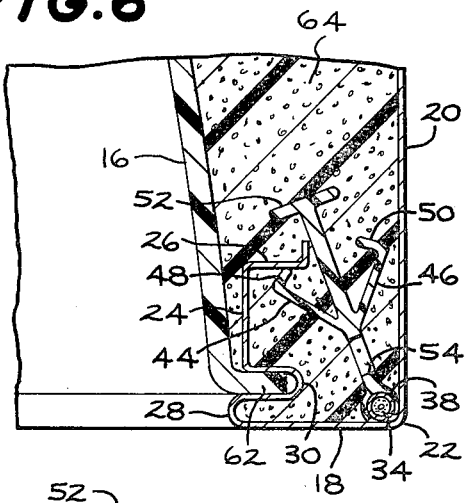
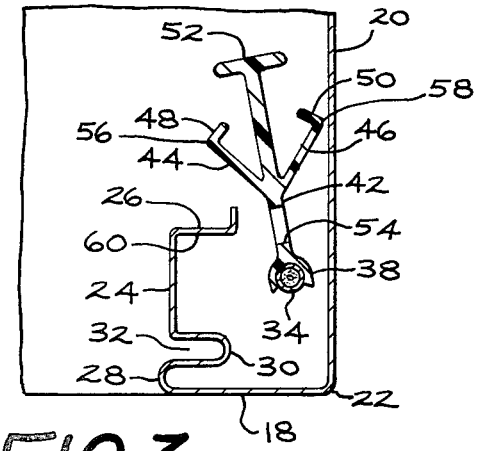
FIG. 3
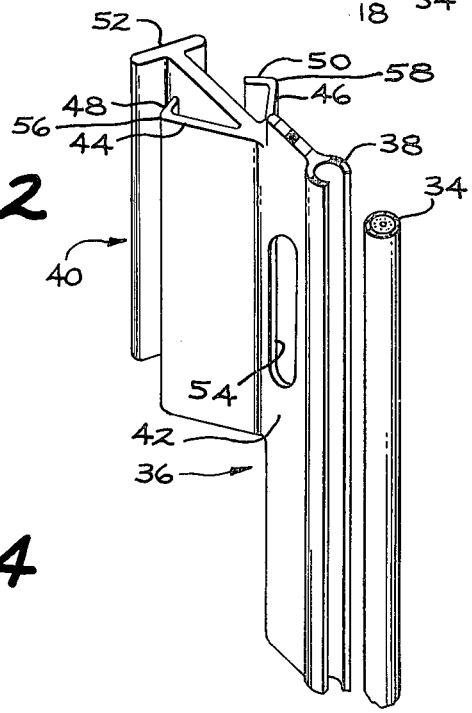
FIG. 2
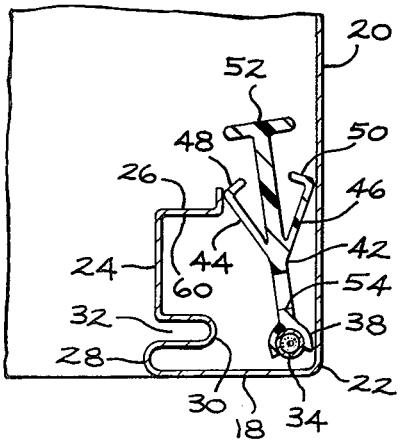
FIG. 4

METHOD OF ASSEMBLING AN ANTI-SWEAT HEATER IN A REFRIGERATOR CABINET

BACKGROUND OF THE INVENTION

Many refrigerator cabinet designs cause certain surface regions of the cabinet to exhibit a tendency to be chilled below the dew point of the ambient air, such that condensate or "sweat" forms on the surfaces. One such region is located about the door sealing gasket and particularly the freezing compartment door sealing gasket. This condensate is unsightly and may have a deleterious effect on surface finish and even wet the floor areas below these regions and, accordingly, it is sought to be avoided in most refrigerator designs. If these regions are heated so as to be warmed above the dew point temperature of the ambient air, the formation of such condensate is avoided.

One approach which is currently widely practiced is the use of electric resistance heating cables disposed within the refrigerator cabinet panels which are turned on and off as needed to prevent the condensate formation. While it is relatively simple to incorporate and readily controllable by a manual control switch, electric resistance heating increases the power required to operate the appliance. If the heater is not properly located and therefore not in good heat transfer relationship with the cabinet outer surfaces it is not as effective to prevent condensate on the cabinet.

The refrigerator system includes structure which is at a relatively elevated temperature, i.e., the compressor and condenser coil. This relatively warm structure thus represents a possible heat source whenever the compressor is running which does not require an extra energy source. Rather, heat may be utilized which is otherwise merely dissipated into the surrounding room air. It is known to utilize a heat transfer system for utilizing this heat source to heat those regions of the refrigerator cabinet which are subject to the formation of condensate. An example of such a system is found in U.S. Pat. No. 4,158,294.

These systems typically incorporate a so-called "secondary loop" refrigerant circulation system in which a loop of tubing containing fluid material which can act as a refrigerant is placed in contact with relatively warm portions of the refrigerator structure such as the compressor housing or the condenser loop. The relatively warm temperature heats the refrigerant within the secondary loop causing it to be vaporized and passed into the upper regions of the loop, which are located at the cabinetry regions to be warmed. The resultant cooling of the heated refrigerant causes the refrigerant to condense releasing heat to warm the cabinet, the liquid refrigerant flowing back to the warm region in liquid form. Repetition of the cycle allows a relatively effective heat transfer means for utilizing the heat source provided by the warm or hot components of the refrigeration equipment. Such "secondary loop" however needs to be placed correctly in the area of the cabinet to be warmed to be effective, as does the electric resistance heating cable mentioned above, and particularly in the case where insulation material will be put in place in the cabinet subsequent to location of the heater in the cabinet.

By this invention, there is provided a method of assembling an anti-sweat heater of either of the types mentioned above in a refrigerator cabinet that assures that it is properly located in the area of the cabinet to be heated for effective prevention of condensate on the cabinet and retained in that area during the subsequent insulation material placement operation, particularly in the case of foamed-in-place insulation.

SUMMARY OF THE INVENTION

According to one aspect of my invention, there is provided a method of assembling an anti-sweat heater in a refrigerator cabinet comprising forming an outer casing of the cabinet with a sidewall and front face with a right angle corner therebetween and a flange spaced from the corner and inwardly turned from the front face with a depending lip extending toward and spaced from the cabinet sidewall. A heater retainer member is formed and has a portion thereof in cross section view including a front end shaped to receive the heater, a straight center section with two flexible wings one on each side of the center section and diverging from the center section away from the front end, and a rear end. The anti-sweat heater is placed in the front end of the retainer member and the heater and front end and center section including the wings of the retainer member are inserted through the space between the depending lip of the flange and the cabinet sidewall. The heater is held in the corner of the cabinet with the front end of the retainer member and the retainer member is moved to position a wing of the retainer member under and in contact with the depending lip of the flange, thereby exerting force against the heater to retain it in the corner. In this manner, the anti-sweat heater is retained in the corner which is its proper position for effective prevention of condensate on the cabinet outer case and is maintained in the corner during subsequent placement of insulating material in the cabinet.

BRIEF DESCRIPTION OF THE DRAWINGS

FIG. 1 is a portion of a household refrigerator cabinet having an anti-sweat heater.

FIG. 2 is a perspective view of the heater retainer member utilized in the present invention.

FIG. 3 is a cross sectional view of a portion of the refrigerator cabinet showing the first step of the method of the present invention.

FIG. 4 is a cross sectional view similar to FIG. 3 showing an intermediate step in the method of the present invention.

FIG. 5 is a cross sectional view of a portion of the cabinet showing the final step of placing the anti-sweat heater in the method of the present invention.

FIG. 6 is similar to FIG. 5 but shows the complete cabinet subsequent to the step shown in FIG. 5.

DESCRIPTION OF THE PREFERRED EMBODIMENT

With reference to FIG. 1, there is shown a household refrigerator 10 having a top freezer compartment 12 closed by a hinged door (not shown) and a bottom fresh food compartment 13 closed by a hinged door 15. The refrigerator has a cabinet outer casing 14 made of formed metal and an inner liner 16 spaced from the outer metal casing 14 to allow placement of thermal insulating material therebetween, which liner is usually made from plastic material. The refrigerator has a front face 18 surrounding the freezer compartment 12 that is formed at a right angle with the sidewall 20 to provide a corner 22 therebetween. With reference to FIGS. 3–5, forming of the cabinet outer case also includes a flange 24 spaced from the corner 22 and inwardly turned from the front face 18 and has a right angle depending lip 26 extending toward but spaced from the cabinet side wall 20. The flange 24 has two reverse bends 28 and 30 spaced from each other to provide an opening 32, which opening will subsequently receive the liner 16 as shown in FIG. 6. The anti-sweat heater, either the electric resistance cable type or secondary loop hot refrigerant type, both of which are referred to herein as anti-sweat heater 34, is shown in FIG. 1 positioned around the openings of the freezer and fresh food compartments 12 and 13 but not along the bottom adjacent the fresh food compartment 13.

With reference to FIG. 2, the heater retainer member 36 is preferably formed by molding as by an extrusion process using suitable plastic material. The heater retainer member is elongated and has at its front end 38 a C-shaped portion which receives the round heater 34 and retains it along the length of the retainer member 36. The retainer member has one or more portions 40 along its length which as viewed in lateral cross section include a straight center section 42 attached to the front end 38 with two flexible wings 44 and 46, one on each side of the center section 42 and diverging from the center section away from the front end 38. Each of the wings has right angle depending inturned flanges 48 and 50 along the outer edges of the wings 44 and 46 respectively. The retainer member 36 has a rear end 52 which in the preferred embodiment is T-shaped to aid the assembler in placing the retainer member 36 in the cabinet, as can be readily seen in the drawings. The center section 42 of the retainer member above the portions 40 have one or more slot openings 54, the purpose of which is to allow the foam insulation material to pass therethrough during the subsequent foaming-in operation since it is desirable that the foam completely encase the retainer member and heater.

After completion of the forming of the cabinet and the molding of the plastic heater retainer member, the heater 34 is placed in the front end 38 of the retainer member and is positioned in the cabinet as shown in FIG. 3. The next step in the assembling of the anti-sweat heater in the refrigerator is inserting the heater 34 and the front end 38 of the retainer member 36 through the space between the depending lip 26 and the cabinet sidewall 20, which space is slightly shorter than the distance between the edges 56 and 58 of the wings 48 and 50, respectively. By the assembler pushing on the T-shaped rear end 52 of the retainer member 36, the diverging wings are flexed toward each other and will pass through the space as shown in FIG. 4.

With reference to FIG. 5, once the heater and the front end and center section, including the wings of the retainer member 36, pass through the space between the lip 26 and the cabinet sidewall 20, the heater 34 is located in the corner 22 which is its preferred position for effective prevention of condensate on the cabinet. To retain the heater in the corner 22 the retainer member is rotated to position a wing, which is wing 44 in the drawings, of the retainer member under and in contact with the depending lip 26 of the flange, as shown in FIG. 5. In the preferred embodiment, the wing 44 has its inturned flange 48 in contact with the lower surface 60 of the lip 26. With this arrangement, then, there is force exerted against the heater 34 to retain it in the corner 22.

After completion of placement of the anti-sweat heater 34 in the refrigerator cabinet, as described above, it is common practice to insulate the cabinet with thermal insulation material 64. In the case of foamed-in-place insulation material the liner 16 of the compartment is attached to the outer metal casing 14 by inserting a depending flange 62 into the previously formed opening 32 in the flange 24, as seen in FIG. 6. After the liner has been attached, then foamed-in-place thermal insulation material is poured between the outer metal casing 14 and the inner liner 16 in the space between the two and the foam surrounds and embeds both the heater wire 34 and the retainer member 36 in the position as shown in FIG. 6. The slots 54 in the center section 42 of the retainer member above the portion 40 allows passage of the foaming material so that it gets dispersed on both sides of the retainer member without any voids.

The foregoing is a description of the preferred method of assembling an anti-sweat heater in a refrigerator cabinet and it should be understood that variations may be made thereto without departing from the true spirit of the invention, as defined in the appended claims.

What is claimed is:

1. A method of assembling an anti-sweat heater in a refrigerator cabinet comprising:

forming an outer casing of the cabinet with a sidewall and front face with a right angle corner therebetween and a flange spaced from the corner and inwardly turned from the front face with a depending lip extending toward and spaced from the cabinet side;

forming a heater retainer member having a portion thereof in cross section view including a front end shaped to receive the heater, a straight center section with two flexible wings one on each side of the center section and diverging from the center section away from the front end each wing having an inturned flange along the outer edge thereof, and a rear end;

placing the anti-sweat heater in the front end of the retainer member;

inserting the anti-sweat heater and the front end and center section including the wings of the retainer member through the space between depending lip of the flange and the cabinet sidewall;

holding the heater in the corner with the front end of the retainer member, and positioning a wing of the retainer member under and in contact with the depending lip of the flange thereby exerting force against the heater to retain it in the corner.

2. The method of claim 1 wherein forming of the heater retainer member includes forming the rear end in the shape of a "T".

3. The method of claim 1 wherein forming of the heater retainer member includes forming an opening through the straight center section.

4. The method of claim 1 wherein forming of the heater retainer member is by molding with plastic material.

5. The method of claim 1 further including attaching a liner member to the flange inwardly turned from the front face and placing insulating material between the liner and cabinet.

6. The method of claim 5 wherein the liner member is attached to the flange first and then the foamed-in-place insulation material is poured between the liner member and cabinet outer casing.

* * * * *